US008415889B2

(12) United States Patent
Hiramatsu et al.

(10) Patent No.: US 8,415,889 B2
(45) Date of Patent: Apr. 9, 2013

(54) LED LIGHTING EQUIPMENT

(75) Inventors: Takuro Hiramatsu, Kanagawa-ken (JP); Masahiko Kamata, Kanagawa-ken (JP); Hiroshi Kubota, Kanagawa-ken (JP); Hiroshi Terasaka, Kanagawa-ken (JP); Toshiyuki Hiraoka, Kanagawa-ken (JP)

(73) Assignee: Toshiba Lighting & Technology Corporation, Kanagawa (JP)

( * ) Notice: Subject to any disclaimer, the term of this patent is extended or adjusted under 35 U.S.C. 154(b) by 202 days.

(21) Appl. No.: 12/845,330

(22) Filed: Jul. 28, 2010

(65) Prior Publication Data

US 2011/0025206 A1 Feb. 3, 2011

(30) Foreign Application Priority Data

Jul. 29, 2009 (JP) ..... 2009-176307
Jun. 17, 2010 (JP) ..... 2010-138780

(51) Int. Cl.
*H05B 37/00* (2006.01)
*H05B 39/00* (2006.01)
*H05B 41/14* (2006.01)

(52) U.S. Cl.
USPC ..... 315/200 R; 315/205; 315/246; 315/272

(58) Field of Classification Search ..... None
See application file for complete search history.

(56) References Cited

U.S. PATENT DOCUMENTS 1,972,790 A 9/1934 Olley
4,355,853 A 10/1982 Kourimsky
4,503,360 A 3/1985 Bedel
4,630,182 A 12/1986 Moroi
4,939,420 A 7/1990 Lim
5,323,271 A 6/1994 Shimada
5,327,332 A 7/1994 Hafemeister
D356,107 S 3/1995 Watanabe et al.
5,537,301 A 7/1996 Martich
5,556,584 A 9/1996 Yamazaki
5,585,697 A 12/1996 Cote
5,607,228 A 3/1997 Ozaki et al.
5,632,551 A 5/1997 Roney (Continued)

FOREIGN PATENT DOCUMENTS

CN 1264152 8/2000
CN 1380704 11/2002

(Continued)

OTHER PUBLICATIONS

English Language Translation of JP 2002-525814 published Aug. 13, 2002.

(Continued)

*Primary Examiner* — Anh Tran
(74) *Attorney, Agent, or Firm* — DLA Piper LLP (US)

(57) ABSTRACT

Certain embodiments provide an LED lighting equipment including a lighting main body. An LED power device has a DC power source and a DC-DC converter having an input terminal connected to the DC power source and the DC-DC converter having an output terminal. An LED light source has a board and a plurality of LED packages; each including a plurality of LED chips connected in series. The LED packages are mounted on the board and connected in series to the output terminal of the DC-DC converter.

2 Claims, 6 Drawing Sheets

U.S. PATENT DOCUMENTS 5,685,628 A 11/1997 Feger et al.
5,775,792 A 7/1998 Wiese
5,785,418 A 7/1998 Hochstein
5,857,767 A 1/1999 Hochstein
5,947,588 A 9/1999 Huang
6,095,668 A 8/2000 Rykowski et al.
6,111,359 A 8/2000 Work et al.
6,161,910 A 12/2000 Reisenauer
6,186,646 B1 2/2001 Wiedemer
6,227,679 B1 5/2001 Zhang et al.
6,234,649 B1 5/2001 Katougi
6,294,973 B1 9/2001 Kimura
6,502,968 B1 1/2003 Simon
6,517,217 B1 2/2003 Liao
6,525,668 B1 2/2003 Petrick
6,598,996 B1 7/2003 Lodhie
6,641,283 B1 11/2003 Bohler
6,787,999 B2 9/2004 Stimac et al.
6,793,374 B2 9/2004 Begemann
D497,439 S 10/2004 Shaw et al.
6,814,470 B2 11/2004 Rizkin et al.
6,936,855 B1 8/2005 Harrah
6,948,829 B2 9/2005 Verdes et al.
6,982,518 B2 1/2006 Chou et al.
7,059,748 B2 6/2006 Coushaine
7,074,104 B2 7/2006 Itaya
7,111,961 B2 9/2006 Trenchard
7,125,146 B2 10/2006 Willis
7,144,140 B2 12/2006 Sun et al.
D534,665 S 1/2007 Egawa et al.
D535,038 S 1/2007 Egawa et al.
7,165,866 B2 1/2007 Li
7,198,387 B1 4/2007 Gloisten et al.
7,226,189 B2 6/2007 Lee et al.
7,281,818 B2 10/2007 You
7,300,173 B2 11/2007 Catalano
7,329,024 B2 2/2008 Lynch
7,331,689 B2 2/2008 Chen
7,347,589 B2 3/2008 Ge
7,431,477 B2 10/2008 Chou et al.
7,497,596 B2 3/2009 Ge
7,625,104 B2 12/2009 Zhang et al.
7,631,987 B2 12/2009 Wei
7,679,096 B1 3/2010 Ruffin
7,744,256 B2 6/2010 Smester
7,758,223 B2 7/2010 Osawa et al.
7,824,075 B2 11/2010 Maxik
7,918,587 B2 4/2011 Hsu et al.
7,919,339 B2 4/2011 Hsu
7,947,596 B2 5/2011 Takeda
7,963,686 B2 6/2011 Hu
8,058,782 B2 11/2011 Lai
8,058,784 B2 11/2011 Treurniet
8,066,417 B2 11/2011 Balazs
8,072,130 B2 12/2011 Wang et al.
8,157,418 B2 4/2012 Kraus
8,226,270 B2 7/2012 Yamamoto et al.
2002/0012246 A1 1/2002 Rincover et al.
2002/0024814 A1 2/2002 Matsuba
2002/0097586 A1 7/2002 Horowitz
2002/0118538 A1 8/2002 Calon et al.
2002/0145152 A1 10/2002 Shimomura
2002/0195918 A1 12/2002 Matsuba et al.
2003/0063476 A1 4/2003 English et al.
2003/0117797 A1 6/2003 Sommers et al.
2003/0117801 A1 6/2003 Lin
2003/0137838 A1 7/2003 Rizkin et al.
2003/0151917 A1 8/2003 Daughtry
2004/0012955 A1 1/2004 Hsieh
2004/0109310 A1 6/2004 Galli
2004/0120156 A1 6/2004 Ryan
2004/0145898 A1 7/2004 Ase et al.
2004/0156191 A1 8/2004 Biasoli
2004/0218385 A1 11/2004 Tomiyoshi
2005/0007772 A1 1/2005 Yen
2005/0024864 A1 2/2005 Galli
2005/0068776 A1 3/2005 Ge
2005/0073244 A1 4/2005 Chou et al.
2005/0111234 A1 5/2005 Martin et al.
2005/0162864 A1 7/2005 Verdes et al.
2005/0174769 A1 8/2005 Yong
2005/0243552 A1 11/2005 Maxik
2005/0254246 A1 11/2005 Huang
2006/0034077 A1 2/2006 Chang
2006/0043546 A1 3/2006 Kraus
2006/0092640 A1 5/2006 Li
2006/0193130 A1 8/2006 Ishibashi
2006/0193139 A1 8/2006 Sun
2006/0198147 A1 9/2006 Ge
2006/0215408 A1 9/2006 Lee
2006/0219428 A1 10/2006 Chinda et al.
2006/0227558 A1 10/2006 Osawa
2006/0239002 A1 10/2006 Chou et al.
2007/0002570 A1 1/2007 Souza
2007/0041182 A1 2/2007 Ge et al.
2007/0096114 A1 5/2007 Aoki
2007/0103904 A1 5/2007 Chen
2007/0247840 A1 10/2007 Ham
2007/0279903 A1 12/2007 Negley
2008/0002100 A1 1/2008 Kaneko
2008/0006911 A1 1/2008 Nakahara et al.
2008/0037255 A1 2/2008 Wang
2008/0080187 A1 4/2008 Purinton
2008/0084701 A1 4/2008 Van De Ven
2008/0112170 A1 5/2008 Trott
2008/0130298 A1 6/2008 Negley
2008/0173883 A1 7/2008 Hussell
2008/0289867 A1 11/2008 Owens
2009/0059595 A1 3/2009 Ge
2009/0116229 A1 5/2009 Dalton
2009/0116231 A1 5/2009 Miller
2009/0175041 A1 7/2009 Yuen et al.
2009/0184616 A1 7/2009 Van de Ven
2009/0184646 A1 7/2009 Devaney
2009/0207602 A1 8/2009 Reed
2009/0294780 A1* 12/2009 Chou et al. ..... 257/88
2009/0315442 A1 12/2009 Otto
2010/0026157 A1 2/2010 Tanaka
2010/0060130 A1 3/2010 Li
2010/0067241 A1 3/2010 Lapatovich
2010/0096992 A1 4/2010 Yamamoto
2010/0207534 A1* 8/2010 Dowling et al. ..... 315/186
2010/0277082 A1 11/2010 Reed
2010/0289396 A1 11/2010 Osawa
2011/0043120 A1 2/2011 Panagotacos
2011/0050133 A1 3/2011 Grajcar
2011/0079814 A1 4/2011 Chen
2011/0090691 A1 4/2011 Markle et al.
2011/0139491 A1 6/2011 Chang

FOREIGN PATENT DOCUMENTS

CN 1433070 7/2003
CN 1644978 7/2005
CN 1880844 12/2006
CN 201014266 1/2008
CN 201081193 7/2008
CN 101307887 11/2008
CN 201180976 1/2009
CN 101506934 8/2009
CN 101521140 9/2009
DE 10 2004 042186 3/2006
DE 20 2008 016 8 4/2009
DE 20 2008 016 231 4/2009
EP 1 215 735 6/2002
EP 1705421 9/2006
EP 2037633 3/2009
EP 2149742 2/2010
EP 2 163 808 3/2010
JP 57-152706 9/1982
JP 59-035303 2/1984
JP 61-35216 2/1986
JP 62-190366 12/1987
JP 63-5581 1/1988
JP 63-102265 5/1988
JP 64-7204 1/1989
JP 1-206505 8/1989
JP 2-91105 3/1990

| | | | |
|---|---|---|---|
| JP | 2000-083343 | | 3/2000 |
| JP | 2000-173303 | | 6/2000 |
| JP | 2001-243809 | | 9/2001 |
| JP | 2002-525814 | | 8/2002 |
| JP | 2002-280617 | | 9/2002 |
| JP | 2003-016808 | | 1/2003 |
| JP | 2003-059305 | | 2/2003 |
| JP | 2003-59330 | | 2/2003 |
| JP | 2003-92022 | | 3/2003 |
| JP | 2004-6096 | | 1/2004 |
| JP | 2004-119078 | | 4/2004 |
| JP | 2004119078 | * | 4/2004 |
| JP | 2004-193053 | | 7/2004 |
| JP | 2004-6096 | | 8/2004 |
| JP | 2004-221042 | | 8/2004 |
| JP | 2005-93097 | | 4/2005 |
| JP | 2005-123200 | | 5/2005 |
| JP | 2005-513815 | | 5/2005 |
| JP | 2005-166578 | | 6/2005 |
| JP | 2005-217354 | | 8/2005 |
| JP | 2005-286267 | | 10/2005 |
| JP | 2006-040727 | | 2/2006 |
| JP | 3121916 | | 5/2006 |
| JP | 2006-156187 | | 6/2006 |
| JP | 2006-244725 | | 9/2006 |
| JP | 2006-28646 | | 10/2006 |
| JP | 2006-310057 | | 11/2006 |
| JP | 2006-313717 | | 11/2006 |
| JP | 2006-313718 | | 11/2006 |
| JP | 2007-073306 | | 3/2007 |
| JP | 2007-188832 | | 7/2007 |
| JP | 2007-207576 | | 8/2007 |
| JP | 2008-027910 | | 2/2008 |
| JP | 2008-91140 | | 4/2008 |
| JP | 2008-227412 | | 9/2008 |
| JP | 2008-277561 | | 11/2008 |
| JP | 2009-37995 | | 2/2009 |
| JP | 2009-037995 | | 2/2009 |
| JP | 2009-117342 | | 5/2009 |
| JP | 2009-135026 | | 6/2009 |
| JP | 2009-164157 | | 7/2009 |
| JP | 2009-206104 | | 8/2009 |
| WO | WO 03/056636 | | 7/2003 |
| WO | WO 2005/024898 | | 3/2005 |
| WO | WO 2006/118457 | | 11/2006 |
| WO | WO 2008/146694 | | 12/2008 |
| WO | WO2009/085231 | | 7/2009 |
| WO | WO 2009/087897 | | 7/2009 |

OTHER PUBLICATIONS

English Language Abstract of JP 2006-156187 published Jun. 15, 2006.
English Language Translation of JP 2006-156187 published Jun. 15, 2006.
U.S. Appl. No. 12/794,558.
U.S. Appl. No. 12/738,081.
Extended European Search Report issued in EP 111560003.9 on May 18, 2011.
Extended European Search Report issued in EP 08838942.4 on Jun. 1, 2011.
English Language Abstract of JP 2008-277561 published on Nov. 13, 2008.
English Language Translation of JP 2008-277561 published on Nov. 13, 2008.
English Language Abstract of JP 2008-227412 published Sep. 25, 2008.
English Language Translation of JP 2008-227412 published Sep. 25, 2008.
Japanese Office Action issued in 2005-269017 on Jan. 13, 2011.
English Language Translation of JP Office Action issued in 2005-269017 on Jan. 13, 2011.
English Language Abstract of JP 2004-221042 published Aug. 5, 2004.
English Language Translation of JP 2004-221042 published Aug. 5, 2004.
English Language Abstract of JP 63-102265 published May 7, 1988.
English Language Abstract of JP 2009-206104 published Sep. 10, 2009.
English Language Translation of JP 2009-206104 published Sep. 10, 2009.
European Search Report issued in EP 10178361.1 on Jul. 4, 2011.
Related U.S. Appl. No. 12/738 081.
English Language Abstract of JP 2001-243809, published Sep. 7, 2001.
English Language Abstract of JP Publication 01-206505 published Aug. 18, 1989.
English Language Abstract of JP Publication 2005-093097 published Apr. 7, 2005.
English Language Abstract of JP Publication 2005-123200 published May 12, 2005.
English Language Abstract of JP 2006-313718, published Nov. 16, 2006.
English Language Abstract of JP Publication 63-005581 published Jan. 11, 1988.
English Language Abstract of JP Publication 64-007402 published Jan. 11, 1989.
English Language Machine Translation of JP 2000-083343, published Mar. 21, 2000.
English Language Machine Translation of JP 2000-173303 published Jun. 23, 2000.
English Language Machine Translation of JP 2001-243809, published Sep. 7, 2001.
English Language Machine translation of JP 2003-59330 published Feb. 28, 2003.
English Language Machine Translation of JP 2004-006096 published Jan. 8, 2004.
English Language Machine Translation of JP 2004-193053 published Jul. 8, 2004.
English Language Machine Translation of JP 2005-166578 published Jun. 23, 2005.
English Language Machine translation of JP 2005-513815 published May 12, 2005.
English Language Machine translation of JP 2006-040727 published Feb. 9, 2006.
English Language Machine Translation of JP 2006-310057, published Nov. 9, 2006.
English Language Machine Translation of JP 2006-313718, published Nov. 16, 2006.
English Language Machine translation of JP 2008-91140 published Apr. 17, 2008.
English Language Machine Translation of JP 2009-37995, published Feb. 19, 2009.
English Language Machine Translation of JP 3121916, published May 10, 2006.
English Language Machine Translation of JP Publication 2005-093097 published Apr. 7, 2005.
English Language Machine Translation of JP Publication 2005-123200.
English Language Machine translation of JP-2002-280617published Sep. 27, 2002.
English Language Machine translation of JP-2005-286267 published Oct. 13, 2005.
English Language Machine translation of JP-2006-244725 published Sep. 14, 2006.
English Language Machine Translation ofJP 2003-092022 published Mar. 28, 2003.
English Language Translation of Office Action issued in corresponding Japanese Appl 2005-221571 on Oct. 20, 2009.
English Language Translation of International Search Report for PCT/JP2008/073436 mailed Mar. 24, 2009.
English translation of Office Action issued in corresponding Japanese Appl 2005-221571 on Jul. 7, 2009.
English translation of Office Action issued in corresponding Japanese Appl 2005-221571 on Aug. 25, 2009.
English Language Translation of Office Action issued in Japanese Appl 2005-221688 on Jan. 26, 2010.
Machine English language translation of JP-2003-016808 published Jan. 17, 2003.

Office Action issued in corresponding Japanese Appl 2005-221571 on Jul. 7, 2009.
Office Action issued in corresponding Japanese Appl 2005-221571 on Aug. 25, 2009.
Office Action issued in corresponding Japanese Appl 2005-221571 on Oct. 20, 2009.
Search Report of International Application No. PCT/JP2008/068625 mailed Dec. 9, 2008.
English Language Abstract of JP 2004-193053 published Jul. 8, 2004.
English Language Abstract of JP 2-91105 published Mar. 30, 1990.
English Language Abstract of JP 2000-173303 published Jun. 23, 2000.
English Language Abstract of JP 2003-092022 published Mar. 28, 2003.
English language abstract of JP-2002-280617 published Sep. 27, 2002.
English language abstract of JP-2003-016808 published Jan. 17, 2003.
English Language Abstract of 2003-59330 published Feb. 28, 2003.
English Language Abstract of JP 2005-166578 published Jun. 23, 2005.
English language abstract of JP-2005-286267 published Oct. 13, 2005.
English Language Abstract of JP 2006-040727 published Feb. 9, 2006.
English language abstract of JP-2006-244725 published Sep. 14, 2006.
English Language Abstract of JP 2008-91140 published Apr. 17, 2008.
English Language Abstract of JP 2004-006096 published Jan. 8, 2004.
Office Action issued in Japanese Appl 2005-221688 on Jan. 26, 2010.
English Language Abstract of JP 2009-37995, published Feb. 19, 2009.
English Language Abstract of JP 2000-083343, published Mar. 21, 2000.
English Language Abstract of JP 57-152706 published Sep. 21, 1982.
English Language Abstract of JP 2006-310057, published Nov. 9, 2006.
International Preliminary Report on Patentability and Written Opinion issued in PCT/JP2008/068625 mailed May 11, 2010.
Office Action issued in Japanese Appl 2005-371406 on Apr. 20, 2010.
English Translation of Office Action issued in Japanese Appl 2005-371406 on Apr. 20, 2010.
U.S. Appl. No. 12/713,230.
U.S. Appl. No. 12/825,956.
Japanese Office Action issued in JP 2008-198625 on May 26, 2010.
English Translation of Japanese Office Action issued in JP 2008-198625 on May 26, 2010.
Amendment filed in JP 2008-198625 on Jun. 28, 2010.
English Translation of Amendment filed in JP 2008-198625 on Jun. 28, 2010.
English Language Abstract of JP 2006-313717 published Nov. 16, 2006.
Machine English Translation of JP 2006-313717 published Nov. 16, 2006.
English Language Abstract of JP 2009-135026 published Jun. 18, 2009.
English Language Translation of JP 2009-135026 published Jun. 18, 2009.
English Language Abstract of JP 2002-525814 published Aug. 13, 2002.
English Language Abstract of JP 2003-059305 published Feb. 28, 2003.
English Language Translation of JP 2003-059305 published Feb. 28, 2003.
English Language Abstract of JP 2009-037995 published Feb. 19, 2009.
English Language Translation of JP 2009-037995 published Feb. 19, 2009.
English Language Abstract of JP 2007-188832 published Jul. 26, 2007.
English Language Translation of JP 2007-188832 published Jul. 26, 2007.
English Language Abstract of JP 2008-027910 published Feb. 7, 2008.
English Language Translation of JP 2008-027910 published Feb. 7, 2010.
English Language Abstract of JP 2007-207576 published Aug. 16, 2007.
English Language Translation of JP 2007-207576 published Aug. 16, 2007.
English Language Abstract of JP 2007-073306 published Mar. 22, 2007.
English Language Translation of JP 2007-073306 published Mar. 22, 2007.
U.S. Appl. No. 12/845,330.
Extended European Search Report issued in EP Appl 10006720.6 on Oct. 13, 2010.
English Language Abstract of JP 61-35216 published Feb. 2, 1086.
IPRP & WO issued in PCT/JP2008/073436 on Aug. 10, 2010.
Related U.S. Appl. No. 12/794,379.
Related U.S. Appl. No. 12/794,429.
Related U.S. Appl. No. 12/794,476.
Related U.S. Appl. No. 12/794,509.
Related U.S. Appl. No. 12/811,795.
Related U.S. Appl. No. 12/738,081.
Related U.S. Appl. No. 12/713,230.
Related U.S. Appl. No. 12/825,956.
Related U.S. Appl. No. 12/885,005.
Related U.S. Appl. No. 12/933,969.
Related U.S. Appl. No. 12/886,025.
Related U.S. Appl. No. 12/886,123.
Related U.S. Appl. No. 13/044,369.
Related U.S. Appl. No. 12/888,921.
Related U.S. Appl. No. 13/221,519.
Related U.S. Appl. No. 13/221,551.
Chinese Office Action issued in CN 201010216943 on Oct. 26, 2011.
English Language Translation of Chinese Office Action issued in CN 201010216943 on Oct. 26, 2011.
English Language Abstract of CN 101307887 published Nov. 19, 2008.
English Language Translation of JP 2009/117342 published May 28, 2009.
English Language Abstract of JP 2009/117342 published May 28, 2009.
Chinese Office Action issued in CN 201010121809.11 on Mar. 31, 2012.
English Translation of Chinese Office Action issued in CN 201010121809.11 on Mar. 31, 2012.
English Language Abstract and Claims of CN201149860 published Nov. 12, 2008.
English Language Abstract Claims of CN201072113 published Jun. 11, 2008.
English Language Abstract of CN2602514 published Feb. 4, 2004.
English Language Abstract of JP 2004-119078 published Apr. 15, 2004.
English Language Translation of JP 2004-119078 published Apr. 15, 2004.
Extended European Search Report for EP 10179580.5, dated May 24, 2012.
Chinese Office Action issued in CN 201010243165.3 on Jul. 17, 2012.
English Language Translation of Chinese Office Action issued in CN 201010243165.3 on Jul. 17, 2012.
English Language Abstract of CN 1264152 published Aug. 23, 2000.
Chinese Office Action issued in CN2010102793033 on Jul. 10, 2012.
English Language Translation of Chinese Office Action issued in CN2010102793033 on Jul. 10, 2012.
English Language Abstract of JP 2005-217354 published Aug. 11, 2005.
English Language Translation of JP 2005-217354 published Aug. 11, 2005.
English Language Abstract of JP 2006-286461 published Oct. 19, 2006.

English Language Translation of JP 2006-286461 published Oct. 19, 2006.
English Language Abstract of WO 2009/085231 published Jul. 9, 2009.
English Language Abstract of CN 1644978 published Jul. 27, 2005.
Chinese Office Action issued in CN 201010292756 dated Jun. 29, 2012.
English Language Translation of Chinese Office Action issued in CN 201010292756 dated Jun. 29, 2012.
English Language Abstract of CN 201014266 published Jan. 30, 2008.
Chinese Office Action issued in CN 2010102927860.6 dated Sep. 29, 2012.
English Language Translation of Chinese Office Action issued in CN 2010102927860.6 dated Sep. 29, 2012.
English Language Abstract of CN 201081193 published Jul. 2, 2008.
English Language Abstract of CN 1380704 published Nov. 20, 2002.
English Language Abstract of CN 101521140 published Sep. 2, 2009.
English Language Abstract of CN 101506934 published Aug. 12, 2009.
English Language Abstract of CN 201180976 published Jan. 14, 2009.
English Language Abstract of CN 1880844 published Dec. 20, 2006.
Chinese Office Action issued in CN 201010292771.4 dated Jun. 19, 20123.
English Language Translation of Chinese Office Action issued in CN 201010292771.4 dated Jun. 19, 20123.
Japanese Office Action issued in JP2009-219771 on Aug. 9, 2012.
English Language Translation of Japanese Office Action issued in JP2009-219771 on Aug. 9, 2012.
English Language Abstract of JP 2009-164157 published Jul. 23, 2009.
English Language Translation of JP 2009-164157 published Jul. 23, 2009.
U.S. Appl. No. 12/825,650.
U.S. Appl. No. 12/794,379.
U.S. Appl. No. 12/794,476.
U.S. Appl. No. 12/794,509.
U.S. Appl. No. 12/811,795.
U.S. Appl. No. 12/738,08.
U.S. Appl. No. 12/880,490.
U.S. Appl. No. 12/885,005.
U.S. Appl. No. 12/933,969.
U.S. Appl. No. 12/885,849.
U.S. Appl. No. 12/886,123.
U.S. Appl. No. 13/172,557.
U.S. Appl. No. 13/221,519.
U.S. Appl. No. 13/221,551.
Chinese Office Action issued in CN201010287917.6 dated Jun. 27, 2012.
English Language Translation of Chinese Office Action issued in CN201010287917.6 dated Jun. 27, 2012.
English Language Abstract of CN 1433070 published Jul. 30, 2003.
Chinese Office Action issued in CN 201010216943 on Jul. 11, 2012.
English Language Translation of Chinese Office Action issued in CN 201010216943 on Jul. 11,2012.
U.S. Appl. No. 12/794,429.
U.S. Appl. No. 12/886,025.
U.S. Appl. No. 13/044,369.
U.S. Appl. No. 12/888,921.
U.S. Appl. No. 13/034,959.

* cited by examiner

LED LIGHTING EQUIPMENT

CROSS-REFERENCE TO RELATED APPLICATION

This application is based upon and claims the benefit of priority from Japanese Patent Application No. 2009-176307 and 2010-138780 filed on Jul. 29, 2009 and Jun. 17, 2010, the entire contents of all of which are incorporated herein by reference.

FIELD

Embodiments described herein relate generally to LED lighting equipment.

BACKGROUND

LED lighting equipment includes an LED package as a source of light mounted on a lighting main body. The LED package includes a plurality of LED chips. An LED power device of the LED lighting equipment is mounted on the lighting main body. Typically the LED package is driven by DC as compared with a traditional incandescent lamp or a compact fluorescent lamp.

Since the LED lighting equipment draws significant current to produce the desired light flux, the LED package generates heat. This heat must be dissipated, because the luminance efficiency of the LED chips falls off when the temperature of the LED chips increases. Furthermore, the LED power device generates heat as it drives the LED package. Thus, it is helpful to control the generation of heat in an LED power device.

DETAILED DESCRIPTION

Certain embodiments provide an LED lighting equipment including a lighting main body. An LED power device has a DC power source and a DC-DC converter having an input terminal connected to the DC power source and the DC-DC converter having an output terminal. An LED light source has a board and a plurality of LED packages, each including a plurality of LED chips connected in series. The LED packages are mounted on the board and connected in series to the output terminal of DC-DC converter.

Figure 1:
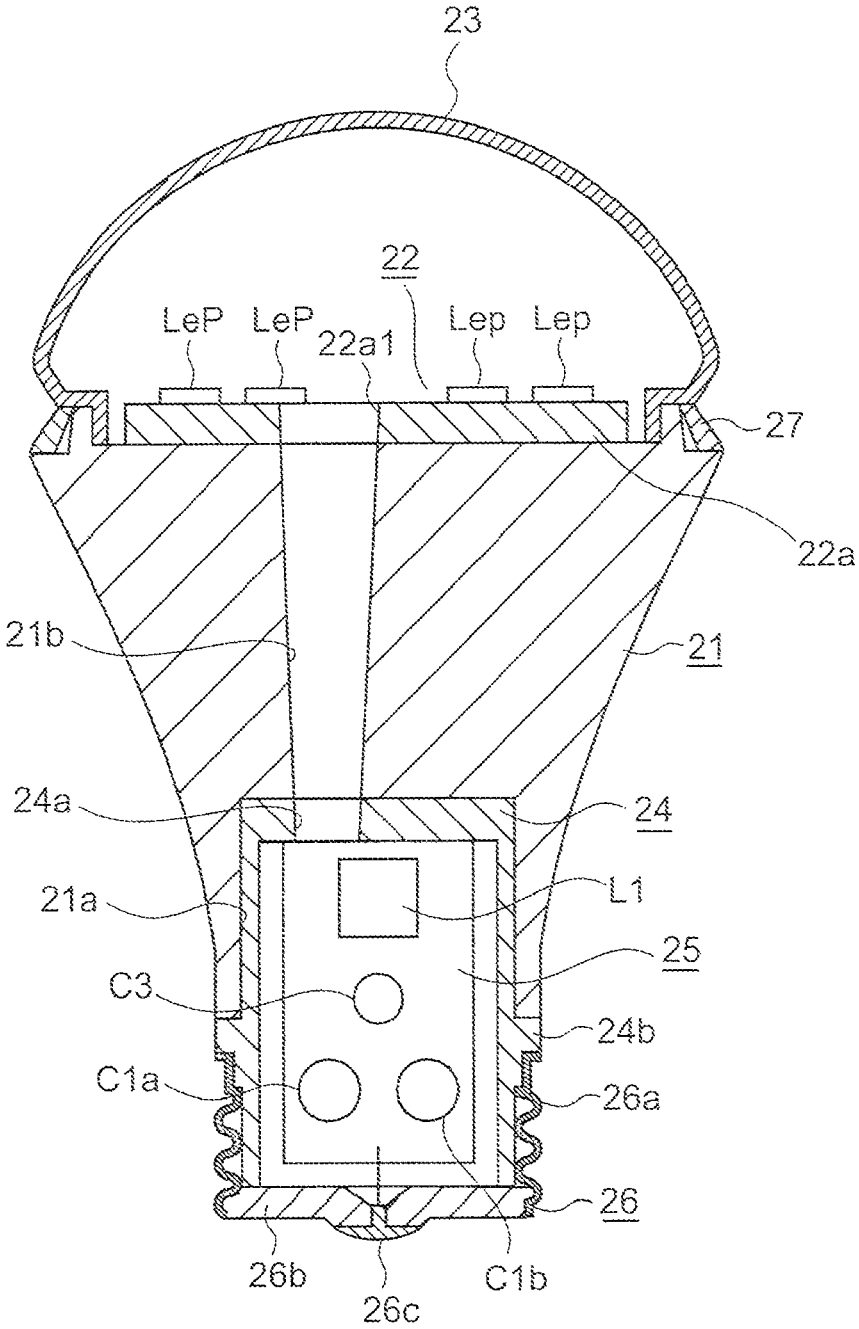
FIG. 1 is a vertical cross-sectional view of a LED lamp using an LED power device of the a first embodiment.
Figure 2:
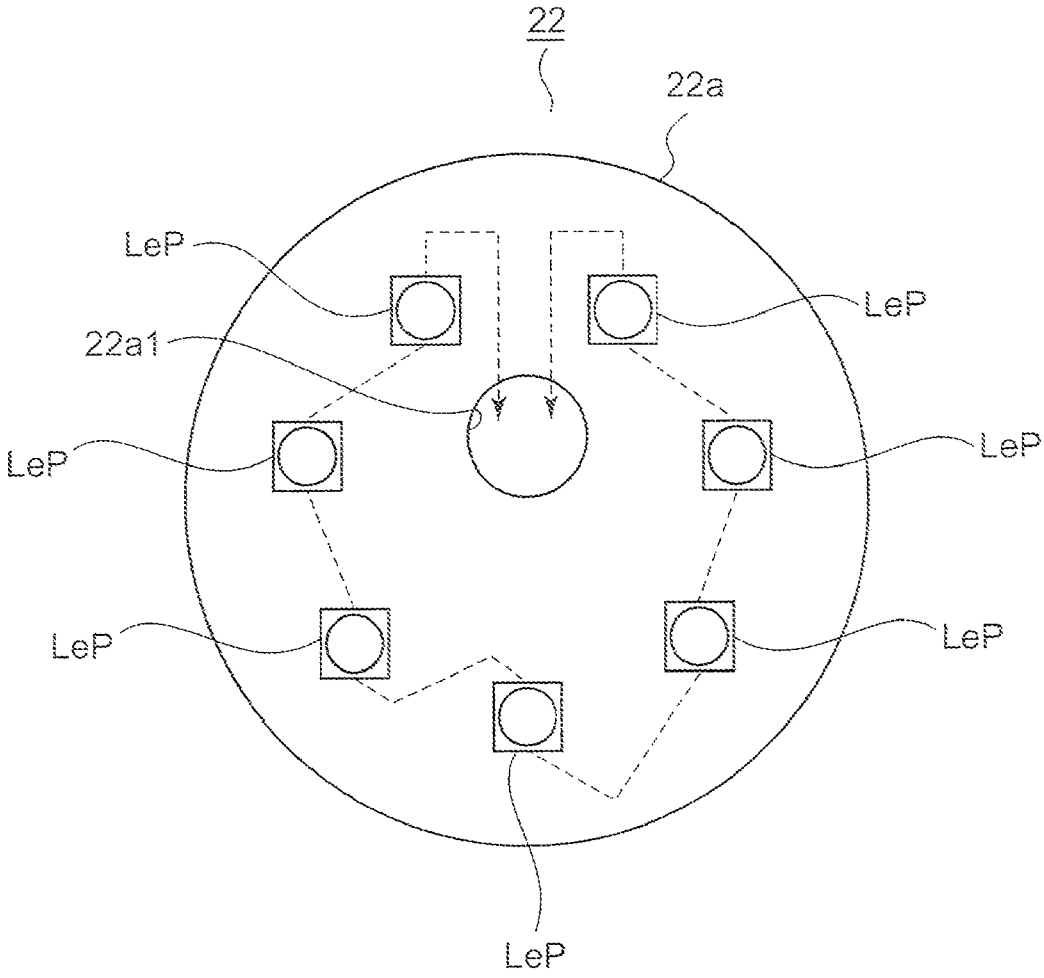
FIG. 2 is a plan view of an LED light source of the LED lamp.
Figure 3:
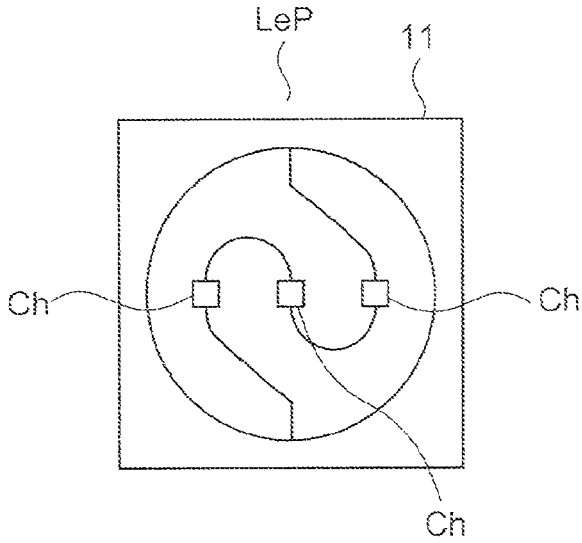
FIG. 3 is a view showing a frame format of an LED package.

In FIGS. 1 to 3, a LED lamp using the above-described LED power device is shown.

The LED lamp is provided with: a lighting main body having a heat dissipation member 21 and a case 24 attached to one end of the heat dissipation member 21; a base 26 attached to one end of the case 24; an LED module substrate 22, which is an LED light source, attached to the other end of the heat dissipation member 21; a globe 23 covering the LED module substrate 22; and the LED power device 25.

The heat dissipation member 21 is provided with: a heat dissipation member main body whose diameter is gradually increased from the base 26 on one end to the LED module substrate 22 on the other end; and a plurality of heat dissipation fins formed on the outer circumferential surface of the heat dissipation member main body. The heat dissipation member main body and the heat dissipation fins are formed, integrally with each other, of metallic material such as aluminum having a satisfactory heat conductivity, resin material or the like.

In the heat dissipation member main body has, on the other end, an attachment recess portion to which the LED module substrate 22 is attached. The one end of the heat dissipation member main body has a fit recess portion 21*a* into which the case 24 is inserted. Moreover, the heat dissipation member main body has an insertion through-hole 21*b* that communicates with the attachment recess portion 21*a*. Furthermore, on a circumferential portion on the other end of the heat dissipation member main body, a groove portion 37 is formed along the circumference to face one end of the globe 23.

The heat dissipation fins are obliquely formed such that the amount of protrusion thereof in a radial direction is gradually increased from the one end to the other end of the heat dissipation member main body. The heat dissipation fins are formed and substantially evenly spaced in a circumferential direction of the heat dissipation member main body.

The insertion through-hole 21*b* is formed such that its diameter gradually increases from the case 24 to the LED module substrate 22.

A ring 27 for reflecting light diffused downward from the globe 23 is attached to the groove portion 37.

The case 24 is formed of an insulating material such as PBT resin and is substantially cylindrically shaped to fit the shape of the fit recess portion 21*a*. The one end of the case 24 is blocked by a blocking plate serving as a case blocking portion; in the blocking plate, a communication hole 24*a* has substantially the same diameter as the insertion through-hole 21*b* and communicates with the insertion through-hole 21*b*. In the outer circumferential surface of an intermediate portion between the one end and the other end of the case 24, a flange portion 24*b* serves as an insulating portion to insulate the area between the main body of the heat dissipation member 21 and the base 26 and is continuously formed to protrude in a radial direction around the circumference.

The base 26 is E26 type; it is provided with: a cylindrical shell 26*a* having screw threads that are screwed into the lamp socket of an unillustrated lighting fitting; and an eyelet 26*c* that is formed via an insulating portion 26*b* in the top portion on one end of the shell 26*a*.

The shell 26*a* is electrically connected to a power supply; inside the shell 26*a*, between the shell 26*a* and the case 24, an unillustrated power line supplies power to the LED power device 25 from the shell 26*a*.

The eyelet 26*c* is electrically connected to an unillustrated ground potential and the ground potential of the LED power device 25 via a lead wire 44.

In the LED module substrate 22, over a substrate 22*a* that is disc-shaped in a plan view, a plurality of LED packages LeP are mounted. The substrate 22*a* is formed of metallic material such as aluminum having satisfactory heat dissipation. In addition, an insulating substrate such as a common printed substrate or a ceramics substrate may be used as the substrate 22*a*. The substrate 22*a* is fixed to the heat dissipation member with an unillustrated screw or the like such that the surface opposite from the surface where the LED packages LeP are mounted makes close contact with the heat dissipation member. In the substrate 22*a*, in a position slightly displaced with respect to the center position, an interconnection hole 22*a*1 communicates with the insertion through-hole 21*b* of the heat dissipation member. The substrate 22*a* may be bonded to the heat dissipation member with a silicon adhesive having excellent heat conduction or the like.

Through the interconnection hole 22*a*1, unillustrated wiring connects electrically between the lighting circuit of the TED power device 25 and the LED module substrate 22. In the vicinity of the interconnection hole 22*a*1, an unillustrated connector receiving portion for connecting a connector disposed at an end portion of the wiring is mounted on the substrate 22*a*.

On the outer edge portion of the LED module substrate 22, the LED packages LeP are disposed substantially spaced on the same circumference having their center in the center position of the LED module substrate 22.

The seven LED packages LeP are connected in series, as shown in FIG. 2. The LED packages LeP are connected across the output capacitor C3 of the LED lighting circuit 25 (See FIG. 4) as described below. Moreover, as shown in FIG. 3, each LED package LeP mounts and confines three LED chips Ch in the inside of a case 11, and connects the three LED chips Ch in series.

Each TED package LeP is provided with: an unillustrated bare chips Ch that emits, for example, light of blue color; and an unillustrated resin portion that is formed of material such as silicon resin covering the bare chips Ch. The resin portion contains an unillustrated fluorescence substance that is excited by part of the blue light emitted from the bare chips Ch to mainly emit light of yellow color that is the complementary color of the blue color, with the result that each LED package generates light of a white color.

Figure 4:
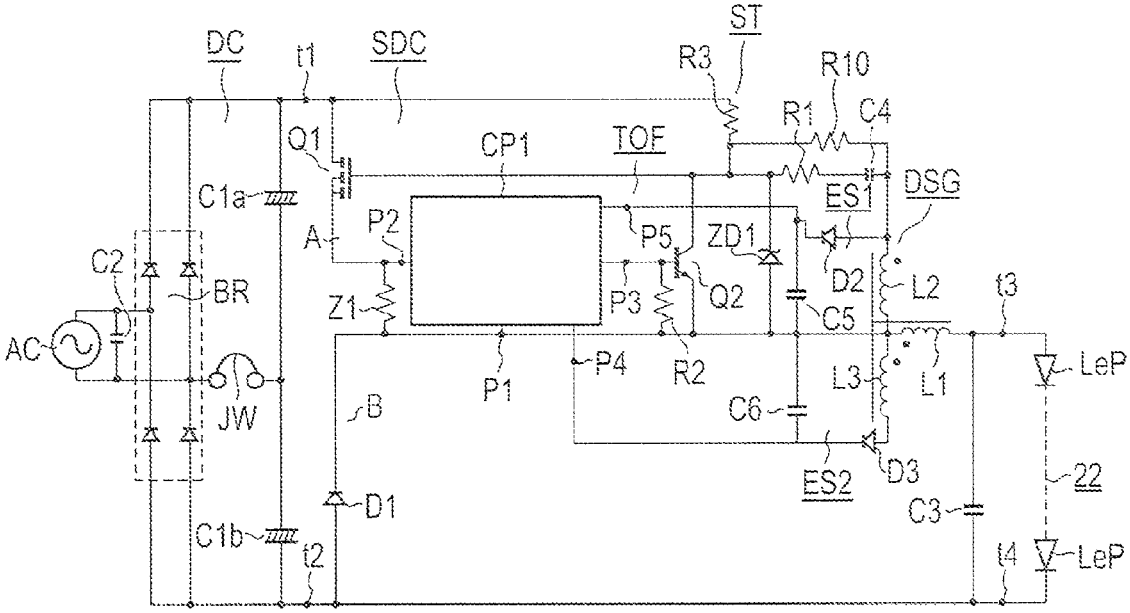
FIG. 4 is a circuit diagram showing an LED power device.

The LED power device 25 is contained in the case 24. FIG. 4 illustrates the circuitry of LED power device 25.

FIG. 4 is a circuit diagram showing a first embodiment of an LED power device.

The LED power device includes a DC power source DC, a step-down chopper SDC, LED packages LeP, a self-excited drive circuit DSG and a turn-off circuit TOF. The self-excited drive circuit DSG and the turn-off circuit TOF constitute a self-excited drive circuit. In addition to these components, a start-up circuit ST is provided.

Figure 5:
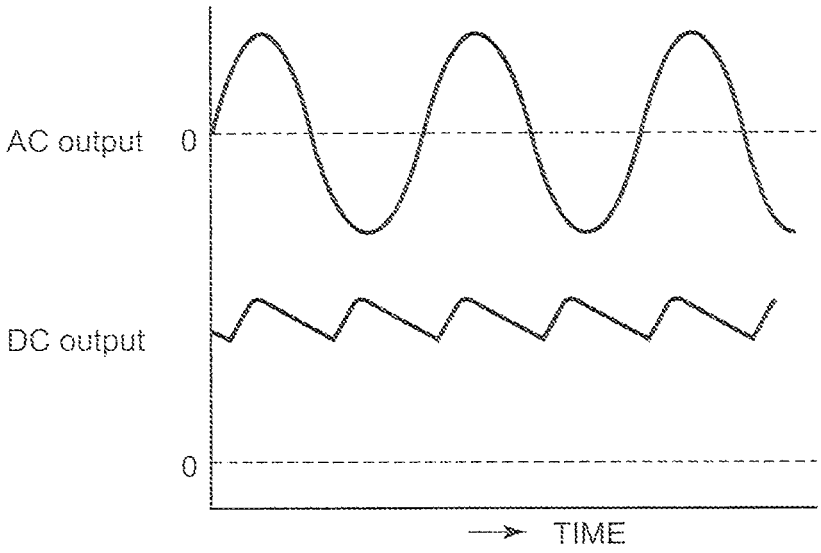
FIG. 5 is a graph showing the relationship between the DC output voltage of a DC power source and the AC output voltage.

The DC-power source DC is provided with: a voltage doubler rectifier circuit whose input terminals are connected to an alternating-current power supply AC such as a commercial alternating-current power supply having, for example, a rated voltage of 100V; and smoothing capacitors C1*a* and C1*b*. The smoothing capacitors C1*a* and C1*b* are connected in series with each other to the output terminals of a bridge rectifier circuit BR. A jumper wire JW which is an example of a select element or a jumper resistor of 0Ω is connected between the bridge rectifier circuit BR and the interconnection between the smoothing capacitors C1*a* and C1*b*. Therefore, as shown in FIG. 5, the output voltage of the DC-power source is 200V, around twice the effective value of the power supply AC voltage. A capacitor C2 that is connected to the input terminals of the voltage doubler rectifier circuit BR provides noise reduction.

The step-down chopper SDC is provided with: input terminals t1 and t2 connected to the DC power source DC; output terminals t3 and t4 connected to a load; a switching element Q1; a first circuit A that includes impedance Z1 and a first inductor L1 connected in series and that is connected between the input terminal t1 and the output terminal t3; and a second circuit B that includes the first inductor L1 and a diode D1 connected in series and that is connected between the output terminals t3 and t4. An output capacitor C3, serving as a smoothing capacitor, is connected between the output terminals t3 and t4.

The switching element Q1 of the step-down chopper SDC is formed with a FET (field effect transistor); the drain and the source thereof are connected to the first circuit A. The first circuit A forms the charging circuit of the first inductor L1 via the output capacitor C3 and/or a load circuit which will be described later; the second circuit B and the diode D1 form the discharging circuit of the first inductor L1 via the first inductor L1 and the output capacitor C3 and/or the load circuit which will be described later, respectively. Although the impedance Z1 is formed with a resistor, an inductor or a capacitor having a resistance component of appropriate magnitude can be used as desired.

A plurality of LED packages are used, these LED packages are connected in series to form the load circuit and this load circuit is connected to the output terminals t3 and t4 of the step-down chopper SDC.

The self-excited drive circuit DSG is provided with a second inductor L2 that is magnetically coupled with the first inductor L1 of the step-down chopper SDC. A voltage induced in the second inductor L2 is applied, as a drive signal, between the control terminal (gate) and the drain of the switching element Q1, with the result that the switching element Q1 is kept on. The other terminal of the second inductor L2 is connected via the impedance Z1 to the source of the switching element Q1.

In addition to the configuration described above, in the self-excited drive circuit DSG, a series circuit composed of a capacitor C4 and a resistor R1 is interposed in series between one end of the second inductor L2 and the control terminal (gate) of the switching element Q1. A Zener diode ZD1 is connected between the output terminals of the self-excited drive circuit DSG, and thus an overvoltage protection circuit is formed so as to prevent the switching element Q1 from being damaged by the application of an overvoltage between the control terminal (gate) and the drain of the switching element Q1.

The turn-off circuit TOF is provided with a comparator CP1, a switching element Q2 and first and second control circuit power supplies ES1 and ES2. The terminal P1 of the comparator CP1 is a terminal on the side of the base potential of a reference voltage circuit inside the comparator CP1 and is connected to the connection point between the impedance Z1 and the first inductor L1. The reference voltage circuit is provided within the comparator CP1; it receives, from the second control circuit power supply ES2, power at a terminal P4 to generate a reference voltage and applies the reference voltage to the non-inverting input terminal of an operational amplifier within the comparator CP1. A terminal P2 is the input terminal of the comparator CP1 and is connected to the connection point between the first switching element Q1 and the impedance Z1, and thus an input voltage is applied to the inverting input terminal of the operational amplifier of the comparator CP1. A terminal. P3 is the output terminal of the comparator CP1 and is connected to the base of the switching element Q2, and thus an output voltage is applied from the comparator CP1 to the switching element Q2. A terminal P5 is connected to the first control circuit power supply ES1, and thus control power is supplied to the comparator CP1.

The switching element Q2 is formed with a transistor. Its collector is connected to the control terminal of the first switching element Q1 and its emitter is connected to the connection point between the impedance element Z1 and the first inductor L1. Therefore, when the switching element Q2 is turned on, the output terminals of the self-excited drive circuit DSG are short-circuited, with the result that the switching element Q1 is turned off. A resistor R2 is connected between the base and the emitter of the switching element Q2.

In the first control circuit power supply ES1, a series circuit composed of a diode D2 and a capacitor C5 is connected across the second inductor L2. With a voltage induced by the second inductor L2 when the first inductor L1 is charged, the capacitor C5 is charged through the diode D2, and a positive potential is output from the connection point between the diode D2 and the capacitor C5 such that a control voltage is applied to the terminal P5 of the comparator CP1.

In the second control circuit power supply ES2, a series circuit composed of a diode D3 and a capacitor C6 is connected across a third inductor L3 that is magnetically coupled to the first inductor L1. With a voltage induced by the third inductor L3 when the first inductor L1 is discharged, the capacitor C6 is charged through the diode D3, and a positive voltage is output from the connection point between the diode D3 and the capacitor C6 such that a control voltage is applied to the reference voltage circuit of the comparator CP1 and the reference voltage is generated in the reference voltage circuit.

The start-up circuit ST is composed of: a series circuit consisting of a resistor R3 connected between the drain and the gate of the first switching element Q1, and a parallel circuit including the resistor R1 and capacitor C4 of the self-excited drive circuit DSG connected in parallel with a resistor R10; and a series circuit consisting of the second inductor L2 and the output capacitor C3 in the second circuit B of the step-down chopper SDC and/or the LED packages in the load circuit. When the DC power source DC is turned on, a positive start-up voltage determined largely by the ratio between the resistance of the resistor R3 and the resistance of the resistor. R10 is applied to the gate of the first switching element Q1, with the result that the step-down chopper SDC is started up.

The operation of the circuit of the LED power device will now be described.

Synthetic electrostatic capacitance of the smoothing capacitors C1*a* and C1*b* is a comparatively low value.

When the DC power source DC is turned on, and the step-down chopper SDC is started up by the start-up circuit ST, the switching element Q1 is turned on, and a linearly increasing current starts flowing from the DC power source DC within the first circuit A through the output capacitor C3 and/or the LED packages in the load circuit. This increasing current allows a voltage whose positive polarity is on the side of the capacitor C4 to be induced in the second inductor L2 of the self-excited drive circuit DSG, and this induced voltage allows a positive voltage to be applied to the control terminal (gate) of the switching element Q1 through the capacitor C4 and the resistor R1, with the result that the switching element Q1 is kept on and that the increasing current continues to flow. At the same time, the increasing current causes a voltage drop in the impedance Z1, and the dropped voltage is applied, as an input voltage to the terminal P2 of the comparator CP1 in the turn-off circuit TOF.

As the current increases, the input voltage of the comparator CP1 increases and then exceeds the reference voltage, with the result that the comparator. CP1 is operated and this generates a positive output voltage at the terminal P3. Consequently, since the switching element Q2 in the turn-off circuit TOF is turned on, and thus the output terminals of the self-excited drive circuit DSG are short-circuited, the switching element Q1 of the step-down chopper SDC is turned off, and thus the current is interrupted.

When the switching element Q1 is turned off, electromagnetic energy stored in the first inductor L1 is discharged, with the result that a decreasing current starts flowing within the second circuit B including the first inductor L1 and the diode D1 through the output capacitor C3 and/or the LED packages in the load circuit. This decreasing current allows a voltage whose negative polarity is on the side of the capacitor. C4 to be induced in the second inductor L2 of the self-excited drive circuit DSG, and this induced voltage allows a negative potential to be applied to the capacitor C4 through the Zener diode ZD1 and also allows a zero potential to be applied to the control terminal (gate) of the switching element Q1, with the result that the switching element Q1 is kept off and that the decreasing current continues to flow.

When the discharge of the electromagnetic energy stored in the first inductor L1 is completed, and then the decreasing current reaches zero, a back electromotive force is generated in the first inductor L1, and thus the voltage induced in the second inductor L2 is reversed and the side of the capacitor C4 becomes positive. Hence, when this induced voltage allows a positive voltage to be applied to the control terminal (gate) of the switching element Q1 through the capacitor C4 and the resistor. R1, the switching element Q1 is turned on again, and thus the increasing current starts to flow again.

Thereafter, the same circuit operation as described above is repeated, and the increasing current and the decreasing current are combined together, and thus a triangular load current flows, with the result that the LED packages LeP in the load circuit LC are lit. In addition, in this embodiment, a voltage depression of the LED chip Ch at the time of lighting is 3V. Then, the voltage depression of one LED package LeP is set to 9V. Therefore, the terminal voltage of the output capacitor C3 is controlled so that the voltage depression of the LED light source 22 is set to 63V.

To achieve the foregoing, the proportion of the fifth harmonic of the input current waveform of the step-down chopper SDC is kept at 60% or less, and the voltage of the smoothing capacitors C1*a* and C1*b* is kept higher than the voltage of the output capacitor C3 over the entire range of an alternating-current voltage period, with the result that the harmonic of the input current is reduced, the step-down chopper SDC is stably operated during the entire time period of the alternating-current voltage period and it is possible to prevent the LED packages LeP from flickering.

In the above-described circuit operation, the operation of the turn-off circuit TOF is performed in two stages, one done with the comparator CP1, the other done with the switching element Q2, and thus, even if the input voltage of the comparator CP1 is 0.3 volts or less, stable and accurate operation is achieved. This makes it possible to reduce the resistance of the impedance Z1, and thus, even when an input voltage is 0.5 volts in the conventional technology, with the present invention, it is possible to reduce the power loss of the impedance Z1 by 40% or more as compared with the conventional technology.

Since the temperature characteristic of the turn-off circuit TOF is determined by the side of the comparator CP1, and thus a desired satisfactory temperature characteristic can be provided for the comparator CP1, the conventional problem in which the temperature characteristic is attributable to the temperature characteristic of the switching element Q2 is solved. Since, with respect to the temperature characteristic of the comparator CP1, for example, as the Zener diode used in the reference voltage circuit of the comparator CP1, it is easy to select the Zener diode whose temperature characteristic is slightly negative or flat, such a characteristic can be given as the temperature characteristic of the comparator CP1. Thus, it is possible to obtain an LED power device with a satisfactory temperature characteristic.

Moreover, the provision of the comparator CP1 in the turn-off circuit TOF allows the switching element Q2 to operate stably and accurately, and this reduces variations in the output of the LED power device.

Figure 6:
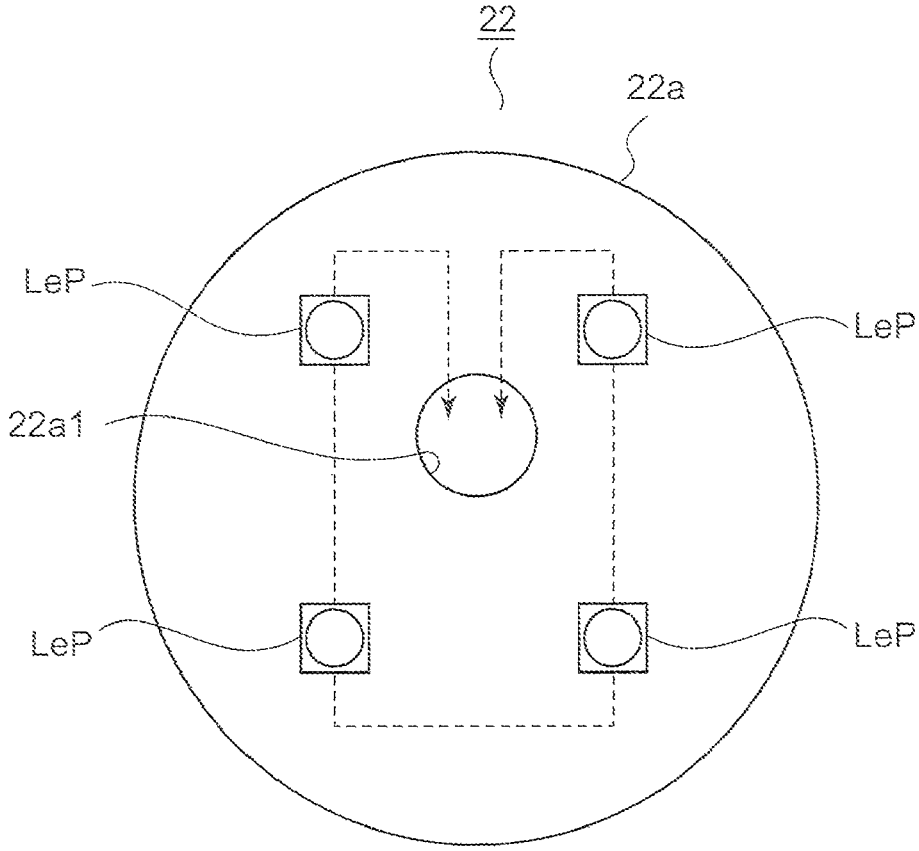
FIG. 6 is a plan view of a LED light source of the LED lamp according to the second embodiment.
Figure 7:
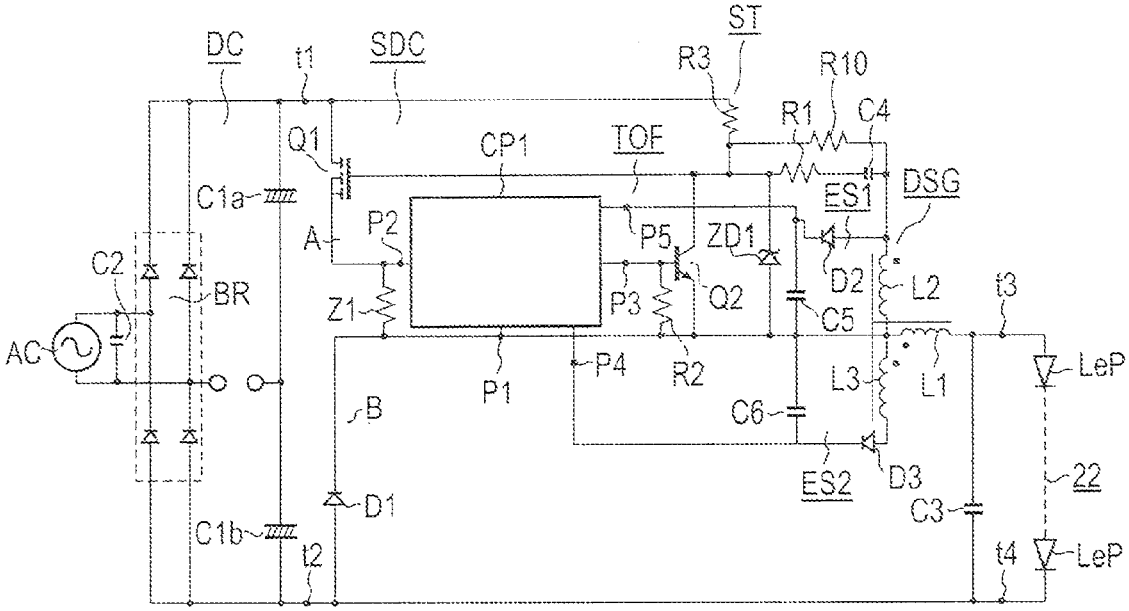
FIG. 7 is a circuit diagram showing an LED power device according to the second embodiment.
Figure 8:
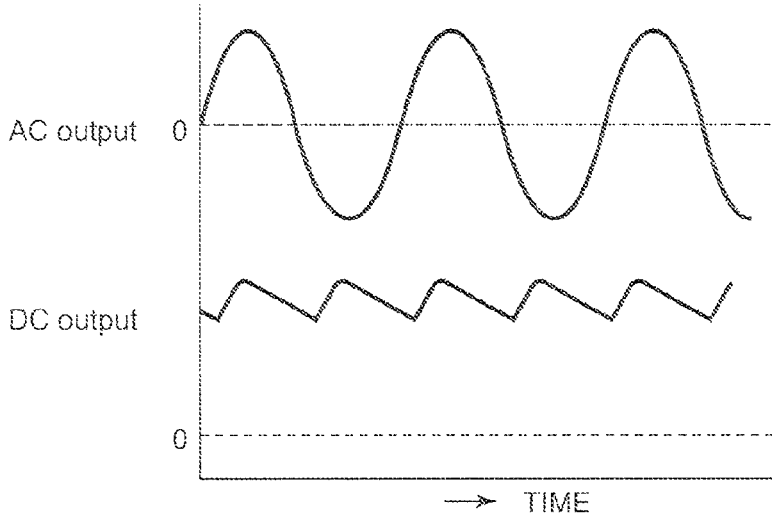
FIG. 8 is a graph showing the relationship between the DC output voltage of a X power source and the AC output voltage according to the second embodiment.

FIGS. 6-8 illustrate a second embodiment for embodying an LED power device. In the embodiment, the same parts as FIGS. 2 and 4 are identified with common symbols, and their description will be omitted. This embodiment mainly differs from the first embodiment in that a full-wave rectifier circuit BR is used as the DC-power source. And that is, the jumper wire JW in FIG. 4 is removed. For this reason, as shown in FIG. 8, the output Voltage of the DC-power source is 100V.

The LED light source includes four LED packages LeP connected in series. In addition, in this embodiment, the voltage depression of the LED chip Ch at the time of lighting is 3V. Then, the voltage depression of one LED package. LeP is 9V. Therefore, the terminal voltage of the output capacitor C3 is controlled so that the voltage depression of the LED light source 22 is set to 36V.

To achieve the foregoing, the voltage of the smoothing capacitors C1*a* and C1*b* is kept higher than the voltage of the output capacitor C3 over the entire range of an alternating-current voltage period, with the result that the harmonic of the input current is reduced, the step-down chopper SDC is stably operated during the entire time period of the alternating-current voltage period and it is possible to prevent brightness of flickering of LED packages LeP.

Each above-mentioned embodiment has the following functional effect.

The LED chips are connected in a series circuit. So, even if the value of the Vf characteristic in the plurality of LED chips varies, the variation has little influence. Therefore, margin of error management of the value of Vf characteristic of the LED chips becomes easy.

Since the LED chips of the LED packages are connected in series, the drive current of these embodiments is related to the inverse of the number of LED chips, as compared with the case that the LED chips are connected in parallel. Also, the generation of heat inside the LED power device is proportional to the square of the drive current. Therefore, circuit efficiency improves, in order that the quantity of heat generated in LED lighting equipment may decrease.

Also, the temperature of the LED power device is about half compared with the case that the LED chips are connected in parallel.

As a result, the life of the LED light source and LED power device increases. Moreover, the reliability of LED power device improves.

In addition, the temperature under operation in the LED power device cannot rise easily. Therefore, less heat needs to be dissipated.

In addition, the LED light source of the embodiments is safe, because all of the LED chips turn off if any of the LED chips becomes faulty in an open mode. When the LED chips are connected in parallel, the remaining LED chips continue to generated heat.

In addition, it is possible to switch between the first and second embodiments of the DC-power source or/and the step-down chopper adding or removing the jumper wire JW of the DC power source.

While certain embodiments have been described, these embodiments have been presented byway of example only, and are not intended to limit the scope of the inventions. In practice, the structural elements can be modified without departing from the spirit of the invention. Various embodiments can be made by properly combining the structural elements disclosed in the embodiments. For example, some structural elements may be omitted from all the structural elements disclosed in the embodiments. Furthermore, structural elements in different embodiments may properly be combined. The accompanying claims and their equivalents are intended to cover such forms or modifications as would fall with the scope and spirit of the inventions.

What is claimed is:

1. An LED lighting equipment, comprising;

a lighting main body:

an LED power device mounted on the lighting main body and including a DC power source and a DC-DC converter, the DC-DC converter including an input terminal connected to the DC power source and an output terminal; and an LED light source including a board and a plurality of LED packages, each of the LED packages including a plurality of LED chips connected in series, the LED packages being mounted on the board and connected in series to the output terminal of DC-DC converter:

wherein the DC power source includes a full-wave rectifier circuit and a voltage doubler rectifier circuit, the full-wave rectifier circuit and the voltage doubler rectifier circuit including a rectification circuit, a smoothing capacitor and selection element configured for implementing one of the rectifier circuits.

2. The LED lighting equipment according to claim 1, wherein:

the LED power device includes an output capacitor connected to the output terminal of the DC-DC converter;

the DC-DC converter is a step-down chopper including a switching element, a first circuit, and a second circuit;

the first circuit is connected between the input terminal of the DC-DC converter and the output terminal of the DC-DC converter, and the first circuit includes an inductor connected to the switching element in series;

the second circuit is connected with the output terminal of the DC-DC converter, and the second circuit includes a series circuit of the inductor and a free-wheel diode; and the output capacitor is configured to operate so that the operating voltage of the output capacitor is lower than an operating voltage of the smoothing capacitor during operation.

* * * * *